US008328743B2

(12) United States Patent
Farrell et al.

(10) Patent No.: US 8,328,743 B2
(45) **Date of Patent: *Dec. 11, 2012**

(54) DYNAMIC HAND SPLINT

(75) Inventors: John F. Farrell, Charlotte, NC (US); Henry B. Hoffman, Charlotte, NC (US)

(73) Assignee: Saebo, Inc., Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/553,170

(22) Filed: Sep. 3, 2009

(65) Prior Publication Data

US 2009/0326428 A1 Dec. 31, 2009

Related U.S. Application Data

(63) Continuation of application No. 11/161,968, filed on Aug. 24, 2005, now Pat. No. 7,601,130, which is a continuation-in-part of application No. 10/373,438, filed on Feb. 25, 2003, now Pat. No. 7,001,352.

(60) Provisional application No. 60/359,810, filed on Feb. 25, 2002.

(51) Int. Cl.
*A61F 5/00* (2006.01)

(52) U.S. Cl. ..... 602/20; 602/21; 602/22

(58) Field of Classification Search ..... 602/20–23, 602/64; 128/877–879; 2/16, 20–21, 159, 2/161.1, 163, 167
See application file for complete search history.

(56) References Cited

U.S. PATENT DOCUMENTS 867,981 A 10/1907 Krizek
3,631,542 A 1/1972 Potter
3,769,970 A 11/1973 Swanson
3,957,266 A 5/1976 Rice
4,173,021 A 10/1979 Zuehner et al.
4,602,620 A 7/1986 Marx
4,765,320 A * 8/1988 Lindemann et al. ..... 602/22
4,772,012 A 9/1988 Chesher
4,790,301 A 12/1988 Silfverskiold
4,858,903 A 8/1989 Tari
4,865,285 A 9/1989 Gaggianese
4,867,246 A * 9/1989 Kiger ..... 172/370
4,875,469 A 10/1989 Brook et al.
4,881,275 A 11/1989 Cazares et al.
4,945,902 A 8/1990 Dorer et al.
4,949,711 A 8/1990 Gyovai et al.
4,960,114 A 10/1990 Dale
4,977,890 A 12/1990 Mann
5,056,504 A 10/1991 Mann
5,162,030 A 11/1992 Tanski
5,205,812 A 4/1993 Wasserman
5,263,593 A 11/1993 Aida
(Continued)

*Primary Examiner* — Michael A. Brown
(74) *Attorney, Agent, or Firm* — Nelson Mullins Riley & Scarborough, LLP

(57) ABSTRACT

A dynamic splint for the positioning and functional exercise of a neurologically impaired upper extremity, including the wrist, hand and fingers, made up of a forearm support and hand support linked by a first connector. Fingertip caps are connected to finger tension leads that extend rearwardly to connect to a finger tensioner attached to the forearm support. The hand support includes adjustable tension lead guides for directing the finger tension leads to the fingertip caps. The dynamic splint also includes a thumb splint assembly made up of a thumb-tip cap connected to a thumb tension lead that extends rearwardly to a thumb tensioner attached to the forearm support. The thumb splint assembly further includes a thumb tension lead guide for directing the thumb tension lead to the thumb-tip cap.

14 Claims, 4 Drawing Sheets

U.S. PATENT DOCUMENTS

| | | | | |
|---|---|---|---|---|
| 5,295,948 | A | 3/1994 | Gray | |
| 5,415,623 | A | 5/1995 | Cherubini | |
| 5,415,624 | A | 5/1995 | Williams | |
| 5,453,064 | A | 9/1995 | Williams, Jr. | |
| 5,456,650 | A | 10/1995 | Williams, Jr. et al. | |
| 5,505,553 | A | 4/1996 | Saviano et al. | |
| 5,514,052 | A | 5/1996 | Charles et al. | |
| 5,538,488 | A | 7/1996 | Villepigue | |
| 5,542,667 | A | 8/1996 | Lezdey et al. | |
| 5,560,375 | A | 10/1996 | Kabanek | |
| 5,584,799 | A | 12/1996 | Gray | |
| 5,599,123 | A | 2/1997 | Still | |
| 5,637,078 | A | 6/1997 | Vam | |
| 5,697,103 | A | 12/1997 | Wiggins | |
| 5,807,293 | A | 9/1998 | Wedge, Jr. | |
| 5,820,577 | A | 10/1998 | Taylor | |
| 5,836,902 | A | 11/1998 | Gray | |
| 5,921,945 | A | 7/1999 | Gray | |
| 6,033,139 | A | 3/2000 | Dutcher | |
| 6,575,926 | B2 | 6/2003 | Bonutti | |
| 6,684,406 | B2 * | 2/2004 | Fowler | 2/16 |
| 6,702,725 | B2 | 3/2004 | Hoffman et al. | |
| 6,854,913 | B2 | 2/2005 | Farrell et al. | |
| 6,918,137 | B2 * | 7/2005 | Fowler | 2/16 |
| 7,001,352 | B2 | 2/2006 | Farrell et al. | |
| 7,601,130 | B2 * | 10/2009 | Farrell et al. | 602/20 |
| 2003/0195093 | A1 | 10/2003 | White | |
| 2006/0211964 | A1 * | 9/2006 | Farrell et al. | 602/5 |

* cited by examiner

DYNAMIC HAND SPLINT

CLAIM OF PRIORITY

This application is a continuation of U.S. patent application Ser. No. 11/161,968, filed Aug. 24, 2005, which is a continuation-in-part of, and claims priority to, U.S. patent application Ser. No. 10/373,438, filed Feb. 25, 2003, now U.S. Pat. No. 7,001,352, issued Feb. 21, 2006, a nonprovisional patent application of, and claims priority to, U.S. Provisional Patent Application No. 60/359,810, filed Feb. 25, 2002, all of which are hereby incorporated herein by reference.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

FIELD OF THE INVENTION

The present invention relates to a dynamic wrist-hand-finger orthosis or splint. In particular, the invention is well suited for the positioning and exercise of a neurologically impaired upper extremity, including the wrist, hand, and fingers.

BACKGROUND OF THE INVENTION

A dynamic wrist-hand-finger orthosis or splint is generally used for the positioning of an impaired, injured, or disabled wrist, hand, and fingers. Splints come in a variety of designs: static, static progressive, and dynamic that can be low profile or high profile.

U.S. Pat. Nos. 5,637,078 and 5,560,375 describe static rigid splints designed to hold the wrist, hand, and fingers in a static position. These splints are used following an injury, during surgery, and post surgery. They are generally made of aluminum with a cushion liner or plastic with a padded liner.

U.S. Pat. No. 4,945,902 describes a static progressive splint as one applying an infinitely adjustable progressive force to a finger, two adjacent fingers, or the thumb. A static progressive splint is designed to increase range of motion to shortened soft tissue.

U.S. Pat. No. 4,765,320 describes the use of a dynamic "low profile" splint to offer a tension force to the finger to overcome stiffness and immobility due to an injury or the hand being immobilized for a period of time. The patent also mentions that whenever possible the patient should be able to perform normal tasks with the splint in place.

U.S. Pat. No. 4,602,620 discloses a prefab splint outrigger system to be used in conjunction with a thermoplastic base. The disclosed system is for use on the postoperative hand for the precise alignment of dynamic splint forces following implant resection arthroplasty of the metacarpophalangeal joints.

All of the above-mentioned prior art and current splints are orthopedic in nature that either holds the hand in a static functional position, or uses a slight dynamic force to position the fingers. None of the known prior art is neurologically based and is designed to allow the user to exercise the impaired upper extremity including the wrist, hand, and fingers.

Many people suffering a neurological injury from stroke, cerebral palsy, brain injury, etc., often have upper extremity impairments. Many have some shoulder and elbow movements, but are unable to extend their wrist or fingers to grasp an object. This is usually due to hypertonicity, described in U.S. Pat. No. 5,807,293 as a condition where the flexor or extensor muscles in the upper extremities is spastic, and resists positioning.

Currently, dynamic splints offer slight resistance to hold a joint in a certain position. An effective dynamic splint designed to be used for hypertonicity must offer enough force to balance the effects of increased muscle tone (hypertonicity). Also current dynamic splints use a variety of finger cuffs to support the digits. These cuffs are not practical when working on a digit affected by hypertonicity, as they move proximal upon closing the fingers, and then have to be repositioned after opening the fingers manually.

Thus, there is a continuing need for a dynamic splint that will address these prior art deficiencies, and provide the user with an improved way to exercise an impaired upper extremity including the wrist, hand and fingers.

SUMMARY OF THE INVENTION

The present invention is directed towards a dynamic splint that exercises a rehabilitating hand by providing resistance to the hand's fingers and thumb. The invention is especially useful for returning the fingers and thumb to an open or extended position after a grasping motion.

The dynamic wrist, hand and finger orthosis or splint is designed for use with the neurologically impaired upper extremity. The splint is used to hold the user's impaired wrist, hand and fingers generally in an extended position, with the thumb in palmer abduction. This position places the impaired hand in the functional position for grasping. The splint also has a dynamic component that offers varying degrees of substantial resistance to all digits, unlike current dynamic splints. The thumb has its own tensioner, and the other four digits, i.e., the fingers, have a combined tensioner, or can have individual tensioners as needed. It is this dynamic force that assists with releasing the object once grasped.

The dynamic splint includes digit caps that can transfer the force of resistance without moving proximally on the finger, and are then able to be opened with the assistance of tensioners. The splint of the invention allows a neurologically impaired upper extremity, including the hand to work on repetitive grasp and release activities while participating in task specific arm training. The benefits of incorporating the neurologically involved hand in upper extremity functional activities have been well documented.

Generally, the dynamic splint of the present invention is comprised of a support having a forearm section and a hand section positioned at an upward angle to the forearm section; a plurality of digit or tip caps for attachment to the user's fingers and thumb; and tensioning means to urge the tip caps upwardly, thereby urging the user's fingers from a gripping position to an open position. The tensioning means is generally comprised of a plurality of longitudinally adjustable leads, i.e., cords or lines, that extend rearwardly from the tips to tensioners, i.e., tension-creating elements, such as extended springs that are attached to the support.

In order to correctly position the tips relative to the support, and to properly align the leads, the dynamic splint also includes a plurality of guides, one for each tip, that extend from the support to adjacent the tips. Each guide includes a lead opening, such as a grommet, with each lead being threaded through a grommet. The guides are preferably longitudinally adjustable, as well as rotatably or laterally adjustable, so that the distal ends of the guides can be positioned to locate the tips at desired positions, taking into account the size of the user's hand and fingers. For example, each guide can be attached to the support with a screw that fits within a longitudinal slot.

The forearm section of the support is a generally rigid band, e.g., a curved plastic sheet, that is sized to fit substantially around a user's forearm. An attachment means, such as one or more hook-and-loop straps are attached to the forearm section to secure the section to the user's forearm. The inner surface of the forearm section can be lined with padding material for comfort. The hand section of the support is generally a rigid plate that is sized to cover a substantial portion of the dorsal part or back of the hand. A releasable attachment means, such as a hook-and-loop strap can be used to secure the hand section to the back of the hand. The inner surface of the hand section can also be padded.

The thumb tip guide used to position the thumb-tip cap is preferably a rod that is rotatably mounted on the support, so that thumb tip guide can be positioned at the appropriate angle. For example, the thumb tip guide can be formed of a rod with proximal and distal sections that are at an angle. The proximal section may be rotatably mounted in substantial longitudinal alignment with the longitudinal axis of the forearm section, so that the distal section of the thumb tip guide is angled outwardly, enabling the distal end of the guide to be positioned over the thumb-tip cap.

In operation, the dynamic splint creates rearwardly directed forces that urge the fingers and thumb into an open hand, fingers extended position. Specifically, the finger tensioner constantly pulls on each finger tension line connected to the fingertip caps urging each finger into an extended position. However, the resistance provided by the tensioner is not so great as to prevent the fingers from moving towards a gripping position. Likewise, the thumb tensioner constantly pulls on the thumb tension line to urge the extension of the thumb, but does so with less force than would prevent the thumb from closing.

These and other aspects of the present invention will become apparent to those skilled in the art after a reading of the following description of the preferred embodiment.

BRIEF DESCRIPTION OF THE DRAWINGS

These and other aspects of the invention, as well as one or more embodiments of the present invention, are disclosed with reference to the accompanying drawings which are briefly described below, wherein the same elements are referred to with the same reference numerals, and wherein various elements are not necessarily shown in conformance to any particular absolute or relative scale.

DETAILED DESCRIPTION

Figure 1:
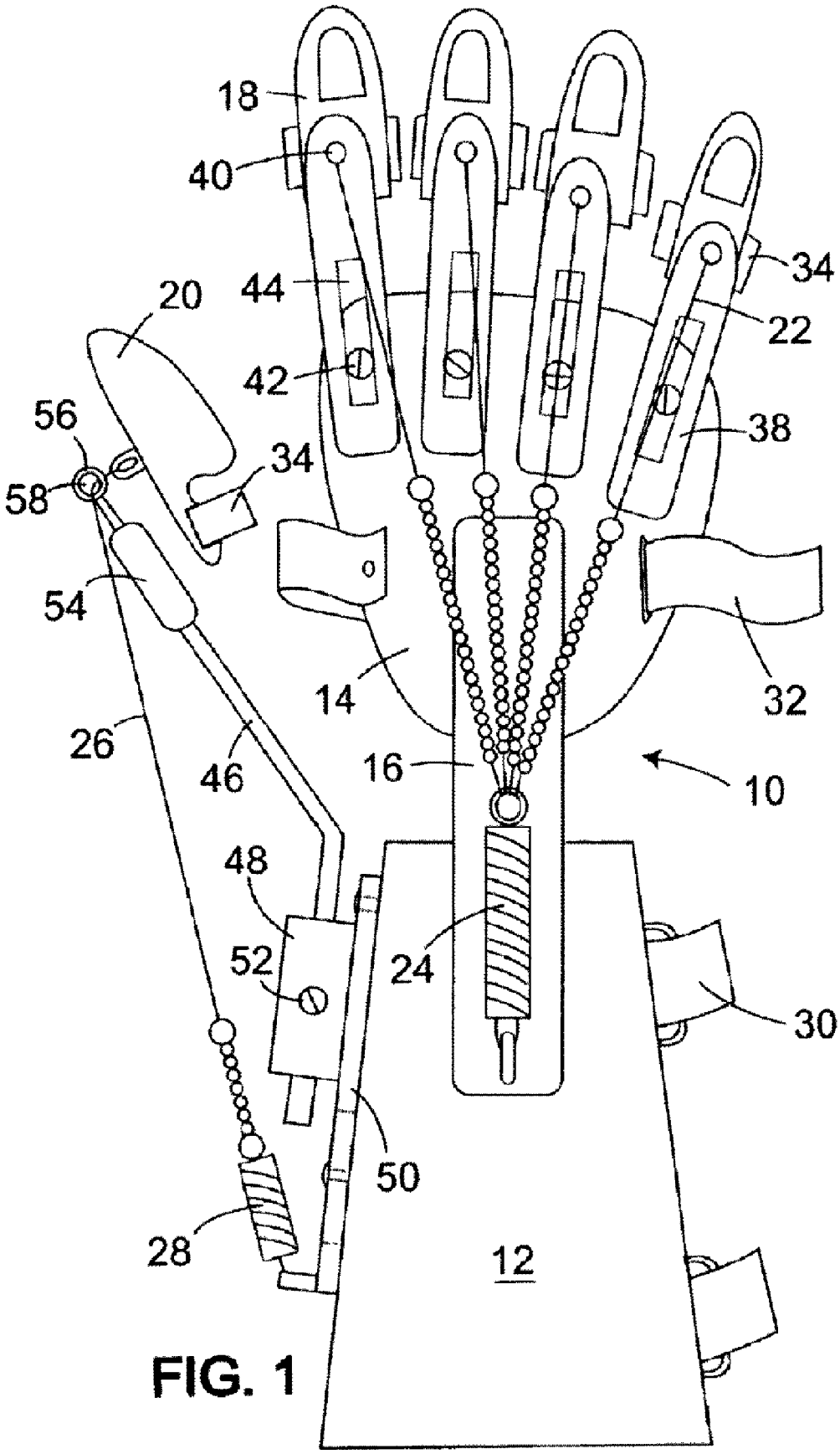
FIG. 1 is a top view of the dynamic splint.

As a preliminary matter, it will readily be understood by one having ordinary skill in the relevant art ("Ordinary Artisan") that the present invention has broad utility and application. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at lease one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Additionally, several terms such as "dorsal," "volar," "radial," and "ulnar," which terms are well-known and are found in the prior art, may be used herein with reference to features of the human hand. Indeed, descriptions herein of one or more illustrated embodiments of the invention sometimes are made with such terms that may imply that the embodiment is disposed on a forearm and hand. Use of such terms of reference is made herein in order to facilitate an understanding of the invention, and the forearm and the hand are not considered in such embodiments to be actual elements of the invention.

For the purpose of interpreting these terms of reference, consider a forearm and open hand resting palm-side down upon a planar desktop, with the forearm and palm generally contacting the desktop, and with the fingers and thumb generally straight and resting their lengths on the desktop. The volar sides of the forearm, wrist, hand, and fingers are generally disposed toward and contact the desktop. The volar side of the hand is sometimes referred to also as the palm side of the hand. Thus, the fingerprints generally are found on the volar sides of fingertips. The dorsal sides of the forearm, wrist, hand, and fingers generally face in opposite direction to the volar sides of the forearm, wrist, hand, and fingers. These dorsal sides thus would be generally oriented away from the desktop. For example, fingernails generally grow from the dorsal sides of the fingers.

The side of the hand from which the thumb depends defines the radial sides of the forearm, wrist, and hand. In contrast, the side of the hand opposing the radial side defines the ulnar sides of the forearm, wrist, and hand. For example, the fourth finger from the thumb of the hand, generally the smallest finger often called the "pinkie" finger, depends from the ulnar side of the hand. In view of these clarifications, these terms of reference are unambiguous and are well-defined with regard to essentially any hand or wrist, including both the left hand and right hand.

Regarding the views of the figures, dorsal views herein refer to views directed toward dorsal sides. For example, a dorsal view of a hand shows the dorsal side of the hand, which side is sometimes called the back of the hand. Similarly, a radial view of a hand would include a showing of the thumb, a volar view of a hand would include a showing of the palm, and an ulnar view of a hand would include a showing of the fourth finger from the thumb.

Regarding planes and axes, volar-dorsal planes are generally perpendicular to radial-ulnar planes, and the forearm generally defines a longitudinal axis. Consider again the forearm and hand resting palm-side down on a planar desktop, particularly when the hand and forearm are comfortably aligned and the fingers are extended straight and held tightly together. In this disposition of the forearm and hand, the plane of the desktop defines a radial-ulnar plane; a longitudinal axis is defined along the length of the forearm; and the four fingers of the hand extend generally parallel to the longitudinal axis. Furthermore, rotation of a radial-ulnar plane by ninety degrees about the longitudinal axis produces a volar-dorsal plane. For example, when a postcard is slipped between adjacent fingers such that an edge of the postcard abuts the desktop and is held parallel to the longitudinal axis, and such that the postcard stands vertically and ninety degrees from the plane of the desktop, the postcard defines a volar-dorsal plane.

It should furthermore be understood that the views of splints found in the accompanying drawings relate to a right forearm, wrist, and hand. For example, portions of a right hand appear in FIG. 2. Nevertheless, the accompanying drawings, and the descriptions herein, by the use of well-defined unambiguous terms, relate as well to splints adapted for a left forearm, wrist, and hand.

Furthermore, terms of reference such as "phalange" and "interphalangeal joint," which terms are well-known and are found in the prior art, may be used herein with reference to the skeletal anatomy of the human hand. Indeed, descriptions herein of one or more illustrated embodiments of the invention sometimes are made with such terms that may imply that the embodiment is disposed on or abuts the hand. Use of such terms of reference is made herein in order to facilitate an understanding of the invention while the hand and portions thereof are not necessarily considered in such embodiments to be actual elements of the invention.

Figure 4:
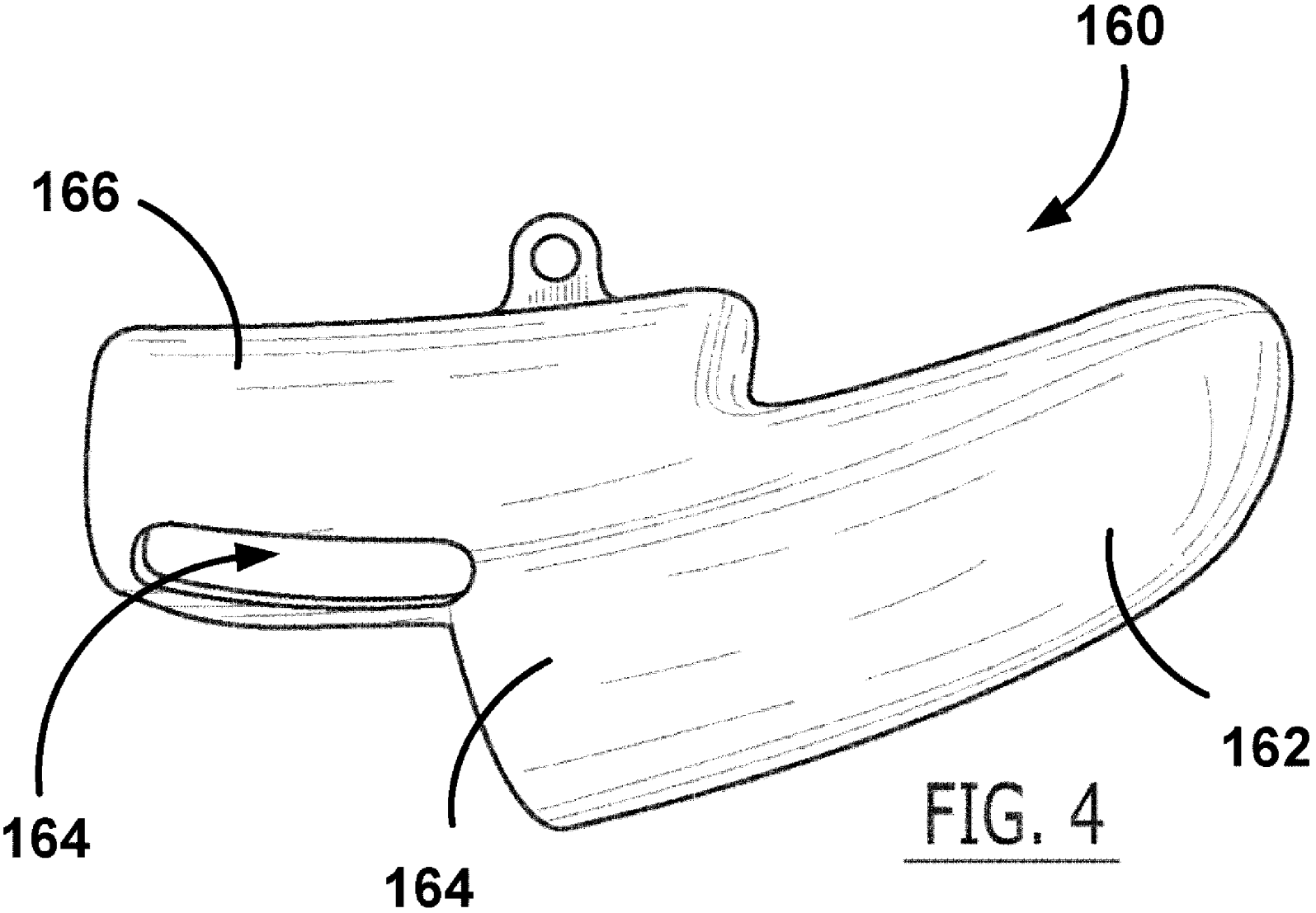
FIG. 4 is an elevational perspective view of a component of a digit cap of the dynamic splint of FIG. 1.

Nonetheless, for the purpose of interpreting these terms of reference, consider FIG. 4 of the U.S. Pat. No. 5,676,157 of Kramer, issued Oct. 14, 1997, which patent is hereby incorporated herein by reference and is referred to as the "Kramer patent." In FIG. 4 of the Kramer patent, the skeletal anatomy of a human hand is illustrated wherein particular bones and joints defined therebetween are identified. For the purpose of interpreting terms of reference as used herein, FIG. 4 of the Kramer patent may be regarded as a dorsal view of a right hand. As shown and as is commonly known, five digits, including a thumb and four fingers, depend from the hand. The phalange bones of any one of the four fingers, disposed in increasing distance from the hand, are referred to as: the proximal phalange; the middle phalange; and the distal phalange. A section of a finger may be referred to herein with regard to a particular phalange without ambiguity in that such a section would include the particular bony phalange and the flesh of the finger about the phalange. For example, in typing or in entering data using a keyboard, distal phalange sections of the fingers generally abut and actuate keys of the keyboard without regard to whether distal phalange bones, which are generally surrounded by the flesh of the fingers, ever contact the keyboard.

With regard to joints, for each of the four fingers illustrated in FIG. 4 of the Kramer patent, a proximal interphalangeal joint is defined between the proximal phalange and the middle phalange, and a distal interphalangeal joint is defined between the middle phalange and the distal phalange. The thumb, however, having less joints than each of the four fingers, generally includes an interphalangeal joint, indicated in said FIG. 4 as "THUMB IP," defined between a proximal phalange and a distal phalange. Thus, any recitation herein relating to the "last joint" or "distal joint" of a digit relates equally to any distal interphalangeal joint of a finger and to any interphalangeal joint of a thumb, regarding either a left hand or a right hand, in a manner consistent with how such terms have long been used in the field of the invention.

Figure 2:
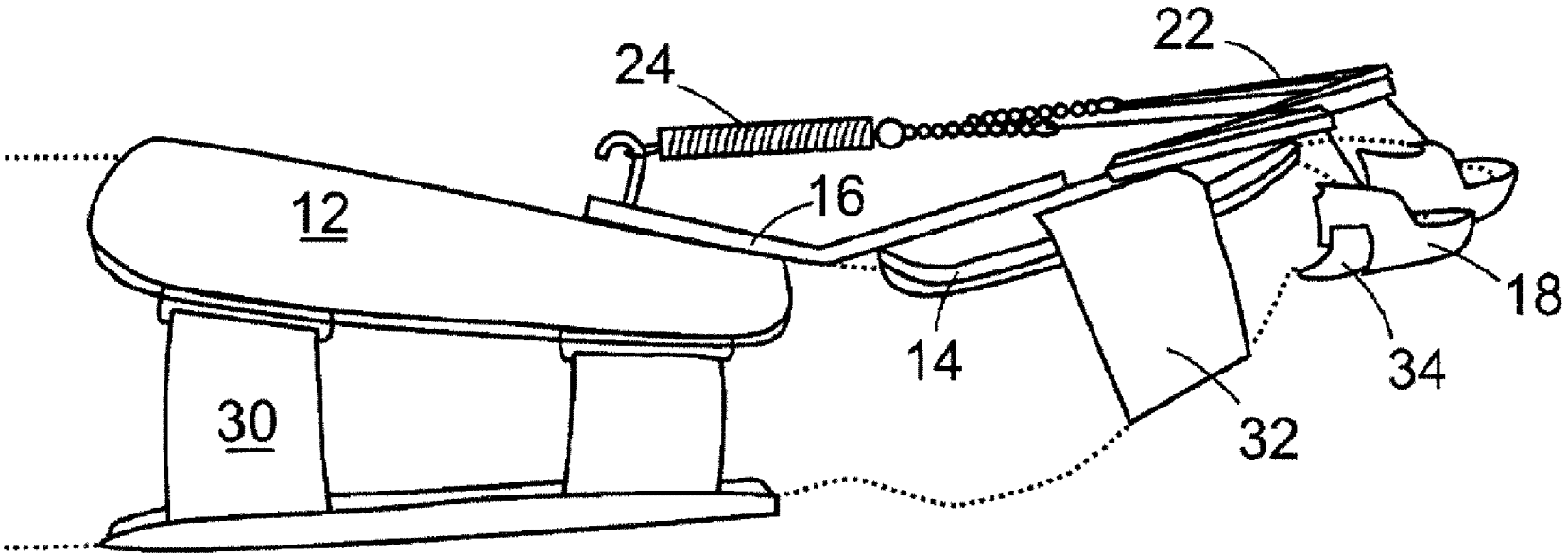
FIG. 2 is a side view of the dynamic splint of FIG. 1.

As illustrated in FIGS. 1-2, a preferred embodiment of the dynamic splint, generally 10, of the present invention is comprised of a forearm support 12, a hand support 14, a support connector 16 to connect forearm support 12 and hand support 14 at an upward angle of approximately 25.degree. to 45.degree. degrees, preferably about 35.degree., raising the user's hand upwardly. A plurality of fingertip caps 18 are positioned over the tips of the user's fingers, while a thumb-tip cap 20 is positioned over the tip of the user's thumb.

In order to urge fingertip caps 18 from a gripping position to an open position, splint 10 further includes a plurality of adjustable finger tension leads 22 having distal ends attached to fingertip caps 18. The proximal ends of leads 22 are attached to finger tensioner 24, which is a spring in the preferred embodiment. Tensioner 24 is secured at its proximal end to forearm support 12. Similarly, a thumb tension lead 26 has a distal end attached to thumb-tip cap 20. A thumb tensioner 28, also a spring in the preferred embodiment, connects the proximal end of thumb tension lead 26 to forearm support 12 to urge thumb-tip cap 20 from a gripping position to an open position. Releasable attachment straps 30, 32, 34 and 36, which are hook-and-loop fasteners in the preferred embodiment, are used to attach forearm support 12, hand support 14, finger tip caps 18 and thumb-tip cap 20, respectively.

Splint 10 also includes adjustable finger tension lead guides 38 to position fingertip caps 18 at the desired longitudinal and lateral locations in relation to hand support 14. Lead guides 38 have proximal ends adjustably attached to hand support 14 and distal ends including lead grommets or openings 40. Guides 38 may be adjusted longitudinally and rotatably to longitudinally and laterally adjust the positions of openings 40 similarly as discussed below with reference FIG. 3. As shown in the preferred embodiment, adjustment is effected by an adjustment screw 42 that is adjustably positioned in a longitudinal slot 44. Each of finger tension leads 22 extends through an opening 40.

Splint 10 also includes a thumb tension lead guide 46 in the form of a bent rod having a proximal end rotatable within a longitudinal bore in mounting block 48. Mounting block 48 is supported on an adjustable base 50 that is slotted at to permit longitudinal and transverse adjustment. A setscrew 52 in block 48 is tightened against guide 46 once guide 46 is in the desired location, holding guide 46 in a fixed position. The longitudinal bore is aligned with the longitudinal axis of forearm support 12. The distal end of thumb tension lead guide 46 includes a threaded coupling nut 54 and thumbscrew 56 to longitudinally adjust guide 46. Thumbscrew 56 includes a bore 58, with thumb tension lead 26 extending through bore 58.

In operation, forearm support 12 is attached around the user's arm with hand support 14 being positioned on the back of the user's hand. Finger tip caps 18 are secured to the user's finger tips and thumb-tip cap 20 is secured to the user's thumb. Finger lead guides 38 are adjusted so that opening 40 is positioned approximately over finger tip caps 18. The distal end of a lead 22 is attached to each of finger tip caps 18 and strung through on opening 40 of a guide 38, and then rearwardly to connect to spring tensioner 24. The lengths of leads 22 are adjusted to place leads 22 under tension, so that tension 24 urges leads 22 rearwardly and thereby urges the user's finger tips from a gripping position to an open position.

Thumb tension lead guide 46 is rotatably positioned within mounting block 48 to a desired position and locked with setscrew 52, and thumbscrew 56 is positioned adjacent the desired location for thumb cap 20. The distal end of thumb tension lead 26 is attached to thumb-tip cap 20 and extends through bore 58 to thumb tensioner 28. The length of lead 26 is also adjusted to place lead 26 under tension, so that tensioner 28 urges leads 26 rearwardly and thereby urges the user's thumb from a gripping position to an open position.

Figure 3:
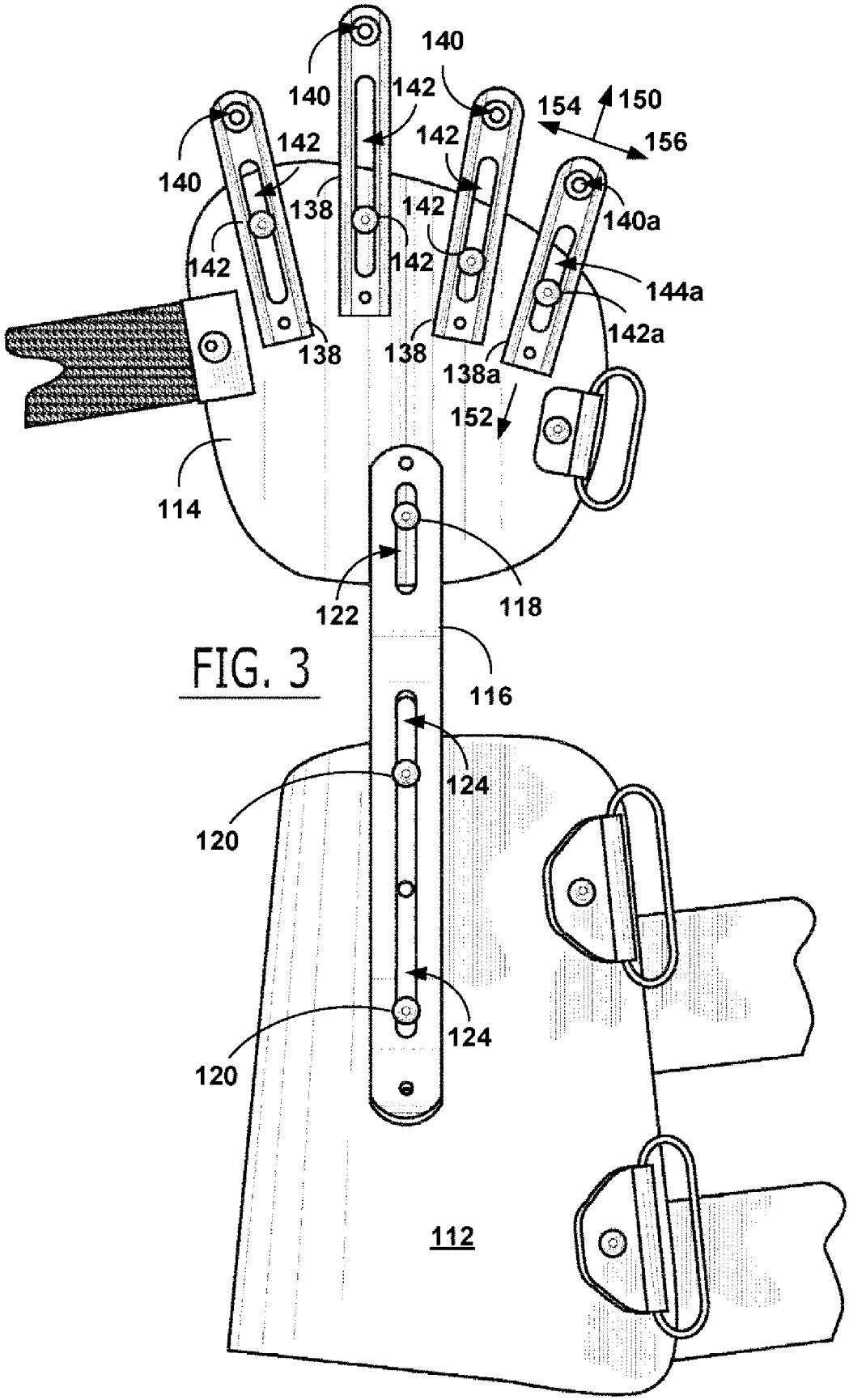
FIG. 3 is a top view of certain components of a dynamic splint similar to the dynamic splint of FIG. 1.

Referring now to FIG. 3, certain components of another dynamic resting hand splint similar to that of FIG. 1 are illustrated while others components are omitted for the purpose of providing clarifying views and descriptions of the illustrated components.

In this regard, a forearm support 112 is attached to a hand support 114 by way of a support connector 116. The relative dispositions of the forearm support, support connector, and hand support are adjustable according to the dispositions of adjustable fasteners 118,120, portions of which are passed through slots defined by the support connector 116.

The fasteners 118,120 comprise conventional fasteners. Exemplary fasteners include, but are not limited to: bolts having threaded posts attached to hexagonal heads, Allen key heads, Phillips heads, slotted heads, or torx heads; screws; bolts and nuts; and thumb-screws. Posts of fasteners 118,120 pass through respective proximal and distal slots 122,124 defined by the support connector and are received and engaged by the forearm support 112 and hand support 114, respectively. The heads of the fasteners are dimensioned to abut the support connector 116 without passing through the slots, whereby the support connector is retained to the forearm support 112 and the hand support 114.

Accordingly, the disposition of the forearm support 112 is adjustable relative to the support connector 116 when the fasteners 120 are loosened, and the disposition of the forearm support 112 relative to the support connector 116 is fixed when the fastener 120 are tightened. Similarly, the disposition of the hand support 114 is adjustable relative to the support connector 116 when the fastener 118 is loosened. Additionally, the forearm support 112 preferably includes an additional opening shown in FIG. 3 for receiving therein the fastener 120 furthermost from the hand so that the hand support 114 may be extended on support connector 116 even further from the forearm support 112, as desired. The disposition of the hand support 114 also is adjustable relative to the support connector 116 by rotation of the hand support 114 about a pivot axes passing through the fastener 118 when the fastener 118 is loosened within slot 122. The disposition of the hand support 112 relative to the support connector 116 is fixed when the fastener 118 is tightened.

Guides 138 are adjustably attached to the hand support 114 so that openings 140 defined in the distal ends of the guides 138 are adjustably disposed relative to the hand support 114. The adjustable disposition of the openings 140 enable the digit caps attached to the lines (see, for example, fingertip caps 18 attached to leads 22 in FIG. 1) passing through the openings 140 can be positioned to locate the digit caps at desired locations on the digits of the hand while taking into consideration the size of the user's hand and fingers. For example, each guide 138 is attached to the hand support 114 by a respective fastener 142, a portion of which is passed through a respective slot 144 defined by the guide 138. The fasteners 142 comprise conventional fasteners. Exemplary fasteners include, but are not limited to: bolts having threaded posts attached to hexagonal heads; Allen key heads; Phillips heads; slotted heads; or torx heads; screws; bolts and nuts; and thumb-screws. Posts of fasteners 142 pass through the respective slots 144 defined by the guides 138 and are received and engaged by the hand support 114. The heads of the fasteners are dimensioned to abut the guides 138 without passing through the slots 144. Thus, the disposition of each guide 138 and, particularly, the disposition of the respective opening 140 defined thereby, is adjustable relative to the hand support 114 when the respective fastener 142 is loosened, and the disposition of the respective opening 140 is fixed relative to the hand support 114 when the respective fastener 142 is tightened.

Thus, for example, the most ulnar guide 138*a* and opening 140*a* defined by the distal end thereof, particularly corresponding to the most ulnar finger of a hand opposite the thumb of the hand (not shown), is movable in a distal direction 150 and a proximal direction 152 relative to the hand support 114 by movement of the guide 138*a* relative to the fastener 142*a* when the fastener 142*a* is loosened in the slot 144*a*. Furthermore, the opening 140*a* defined by the distal end of the guide 138*a* is movable in a radial direction 154 and an ulnar direction 156 by rotation of the guide 138*a* relative to the fastener 142*a* when the fastener 142*a* is loosened.

As shown in FIG. 4, an exemplary digit cap (fingertip cap or thumb tip cap) in accordance with the present invention comprises a digit splint 160 adapted to prevent flexing of the distal interphalangeal joint of a digit when the digit splint 160 is disposed on the digit. The digit splint 160, which is adapted to accommodate a fingers and/or a thumb of the hand, comprises a distal portion 162 for receiving at least the distal phalange section of the digit, a collar 164 connected to the distal portion for circumferential disposition about a digit, and a proximal portion 166 connected to the collar 164. The digit splint 160 is adapted to abut at least the distal phalange and a more medial section of a digit. That is, insofar as the digit splint 160 is adapted to accommodate a particular one of the four fingers of a hand, the digit splint is adapted to abut at least a portion of distal phalange section and at least a portion of the middle phalange section of the finger, thereby spanning or bridging the distal interphalangeal (DIP) joint. Moreover, insofar as the digit splint 160 is adapted to accommodate a thumb, the digit splint is adapted to abut at least a portion of the distal phalange section and at least a portion of the proximal phalange section of the thumb, thereby spanning or bridging the interphalangeal joint of the thumb.

Furthermore, the distal portion 162, collar 164, and proximal portion 166 define a rigid frame, such that the digit cap 160 prevents flexing of the distal interphalangeal joint of a finger and/or interphalangeal joint of the thumb when the digit splint is donned. Optionally, the distal portion 162, collar portion 164, and proximal portion 166 are integrally formed, for example, from molded plastic to define a rigid unitary article. Furthermore, a pliable layer may be attached to the rigid frame for frictionally retaining the digit splint in its disposition on a digit. The pliable layer, for example, may be an elastomeric material that is co-molded about the rigid frame.

Slots 168 are defined in the proximal portion 166 of the digit splint 160 for passage there through of a strap for wrapping at least partially about a digit to secure and retain the digit splint in its disposition on the digit.

We claim:

1. A splint for a hand, comprising:

(a) a support having at least a hand section sized to cover a substantial portion of a dorsal surface of the hand, and a forearm section operatively coupled to said hand section;

(b) at least one tensioner having a first end operatively coupled to said support and an opposite second end; and (c) at least one fingertip cap having a rigid dorsal structure adjacent a dorsal surface of a digit of the hand and a rigid volar structure adjacent a volar surface of the digit of the hand, wherein i. said rigid dorsal and said rigid volar structures are configured to restrict bending of the distal inter-phalangeal joint of the digit; and ii. said fingertip cap is operatively coupled to said at least one tensioner second end and suspended from said support by said at least one tensioner, said fingertip cap being adapted to receive the digit of the hand;

wherein said at least one tensioner is configured to urge said fingertip cap toward an open position of the hand and away from a gripping position of the hand.

2. The splint of claim 1, wherein said suspended fingertip cap is adapted to extend across the distal inter-phalangeal joint of the digit and terminate between the distal inter-phalangeal joint and a back of the hand.

3. The splint of claim 2, wherein said tensioner first end is coupled to said hand section.

4. The splint of claim 1, wherein said fingertip cap further comprises a generally cylindrical body having an open first end and a closed second end.

5. The splint of claim 4, wherein said fingertip cap open first end is operatively coupled to a strap adapted to secure said fingertip cap on the digit.

6. The splint of claim 4, wherein said fingertip cap further comprises at least one opening intermediate said open first end and said closed first end.

7. The splint of claim 1, wherein said fingertip cap is adapted to receive and retain therein an end of a thumb.

8. The splint of claim 1, further comprising a plurality of tensioners, each tensioner having a first end operatively coupled to said hand section and an opposite second end.

9. The splint of claim 8, further comprising a plurality of fingertip caps, wherein a respective fingertip cap is operatively coupled to a respective one of said plurality of tensioner second ends and suspended from said hand section by said respective one of said plurality of tensioners.

10. The splint of claim 1, wherein said hand support may be disposed at a preset position with respect to said forearm support.

11. The splint of claim 1, wherein said hand support moves with respect to said forearm support.

12. A method of exercising a digit of a hand comprising:

(a) providing a hand splint having i. a support having at least a hand section sized to cover a substantial portion of a dorsal surface of the hand, and a forearm section operatively coupled to said hand section;

ii. at least one tensioner having a first end operatively coupled to said support and an opposite second end; and iii. at least one fingertip cap operatively coupled to said at least one tensioner second end and suspended from said support by said at least one tensioner, said fingertip cap having a rigid dorsal surface adjacent a dorsal surface of the digit of the hand and a rigid volar surface adjacent a volar surface of the digit of the hand, said fingertip cap being adapted to receive the digit of the hand and cover a distal inter-phalangeal joint of the digit;

(b) securing said hand section to the back of the hand;

(c) securing said fingertip cap onto the end of the digit so that said fingertip cap rigid dorsal and rigid volar surfaces restrict bending of the distal inter-phalangeal joint; and (d) flexing at least one joint of the digit against tension exerted by said at least one tensioner, said at least one tensioner urging another joint of the digit toward an extended position moving the digit from a grasping position toward a releasing position.

13. The method of claim 12, further comprising the step of changing the relative position of said forearm section with respect to said hand section.

14. The method of claim 12, wherein the step of securing said fingertip cap onto the end of the digit further comprises securing a strap operatively coupled to the fingertip cap to the digit.

* * * * *